US011629598B2

(12) United States Patent
Kawada et al.

(10) Patent No.: US 11,629,598 B2
(45) Date of Patent: Apr. 18, 2023

(54) BLADE DAMAGE EVALUATION APPARATUS, BLADE DAMAGE EVALUATION METHOD, AND BLADE DAMAGE EVALUATION PROGRAM

(71) Applicant: TOSHIBA ENERGY SYSTEMS & SOLUTIONS CORPORATION, Kawasaki (JP)

(72) Inventors: Yasutaka Kawada, Kawasaki (JP); Yusuke Suzuki, Yokohama (JP); Shota Nakajima, Yokohama (JP); Yasuteru Kawai, Yokohama (JP)

(73) Assignee: TOSHIBA ENERGY SYSTEMS & SOLUTIONS CORPORATION, Kawasaki (JP)

( * ) Notice: Subject to any disclaimer, the term of this patent is extended or adjusted under 35 U.S.C. 154(b) by 0 days.

(21) Appl. No.: 17/814,331

(22) Filed: Jul. 22, 2022

(65) Prior Publication Data

US 2023/0048806 A1 Feb. 16, 2023

(30) Foreign Application Priority Data

Aug. 10, 2021 (JP) ..... JP2021-130513

(51) Int. Cl.
*F01D 21/00* (2006.01)
*F01D 5/12* (2006.01)

(52) U.S. Cl.
CPC ..... *F01D 5/12* (2013.01); *F01D 21/003* (2013.01); *F05D 2260/83* (2013.01); *F05D 2270/80* (2013.01)

(58) Field of Classification Search
CPC ..... F01D 21/003; F01D 5/12; F05D 2260/83; F05D 2260/80; F05D 2230/80; F05D 2230/72
See application file for complete search history.

(56) References Cited

U.S. PATENT DOCUMENTS 9,581,086 B2 * 2/2017 Tiwari ..... F02C 9/00
9,816,897 B2 * 11/2017 Ziarno ..... G07C 5/0841
(Continued)

FOREIGN PATENT DOCUMENTS

JP 56-12682 2/1981
JP S56-12682 3/1981

*Primary Examiner* — Eldon T Brockman
(74) *Attorney, Agent, or Firm* — Oblon, McClelland, Maier & Neustadt, L.L.P.

(57) ABSTRACT

A blade damage evaluation apparatus includes: a registration unit for design information of a turbine and maintenance information; an acquisition processor for detection data of sensors; a first discrimination processor for first facility states of the turbine at a plurality of past time points; a classification processor for classes $C_n$ of a plurality of first facility states; a first determination processor for first operating state values of the turbine; another registration unit for first damage rates at past time points; a setting processor of a characteristic function for each of the classes $C_n$; a second discrimination processor for a second facility state of the turbine at the current time point; a second determination processor for a second operating state value of the turbine at the current time point; and an analyzer for a second damage rate at the current time point.

6 Claims, 4 Drawing Sheets

(56) References Cited

U.S. PATENT DOCUMENTS

| | | | | |
|---|---|---|---|---|
| 11,199,105 | B2 * | 12/2021 | Wang | G06T 7/001 |
| 2007/0258807 | A1 * | 11/2007 | Brummel | F02C 9/00 415/118 |
| 2015/0330869 | A1 * | 11/2015 | Ziarno | G01M 15/14 701/34.4 |
| 2018/0135455 | A1 * | 5/2018 | Khibnik | F01D 21/003 |
| 2019/0264573 | A1 * | 8/2019 | Nagano | F02C 7/00 |

* cited by examiner

BLADE DAMAGE EVALUATION APPARATUS, BLADE DAMAGE EVALUATION METHOD, AND BLADE DAMAGE EVALUATION PROGRAM

CROSS-REFERENCE TO RELATED APPLICATION

This application is based upon and claims the benefit of priority from Japanese Patent Application No. 2021-130513, filed on Aug. 10, 2021, the entire contents of which are incorporated herein by reference.

FIELD

Embodiments of the present invention relate to a technique for evaluating blade damage in association with operation of a turbine.

BACKGROUND

In a turbine, blades are subjected to a jet of high-temperature and high-pressure steam or gas generated by heating in, for example, a boiler or a combustor so as to obtain driving force and rotate. In this steam or gas, solid particles are mixed. Although a capturing method such as a strainer is provided at an appropriate position such as a steam valve for the purpose of excluding all the solid particles, it is inevitable that a certain rate of the solid particles flow into the inside of the turbine. When the solid particles mixed in the steam or gas collide with the surfaces of the respective blades, the blades are thinned from the surfaces. This is due to occurrence of SPE (Solid Particle Erosion), i.e., phenomenon in which the surface is eroded or worn by the collision of the solid particles.

In particular, of the blades provided on the turbine rotating shaft in multiple stages, the thickness-loss due to SPE is remarkable in the first-stage rotor blades. The thickness-loss amount (i.e., reduction in thickness) of the first-stage rotor blades is managed in such a manner that the thickness-loss amount does not exceed a threshold value determined on the basis of strength evaluation of the blades. In a conventional general management method, the thickness-loss amount is measured at the time of a major inspection of the turbine, and parameters such as a thickness-loss rate are calculated from the thickness-loss amount measured at the previous inspection. On the basis of the relationship between the thickness-loss rate and the threshold value, the time for the next major inspection or the recommended time for blade replacement is estimated.

[Patent Document 1] Japanese Examined Patent Publication No. S56-12682

However, in the above-described conventional management method, it is required to periodically open the casing of the turbine and measure the thickness-loss amount of the rotor blades, which has a problem that a considerable number of processes and a considerable construction period are required. In recent years, thermal power generation is expected to be operated as adjustable thermal power such as low load operation and variable load operation, unlike the conventional baseload operation. Since the conventional prediction of thickness-loss amount due to SPE is on the premise of the baseload operation, it is difficult to apply the conventional prediction to the prediction of thickness-loss amount due to SPE when the turbine is operated as adjustable thermal power by dynamically changing the operating conditions.

SUMMARY OF THE INVENTION

In view of the above-described circumstances, embodiments of the present invention aim to provide a technique for accurately evaluating blade damage of a turbine that is operated under dynamically changing operating conditions.

DETAILED DESCRIPTION

Figure 1:
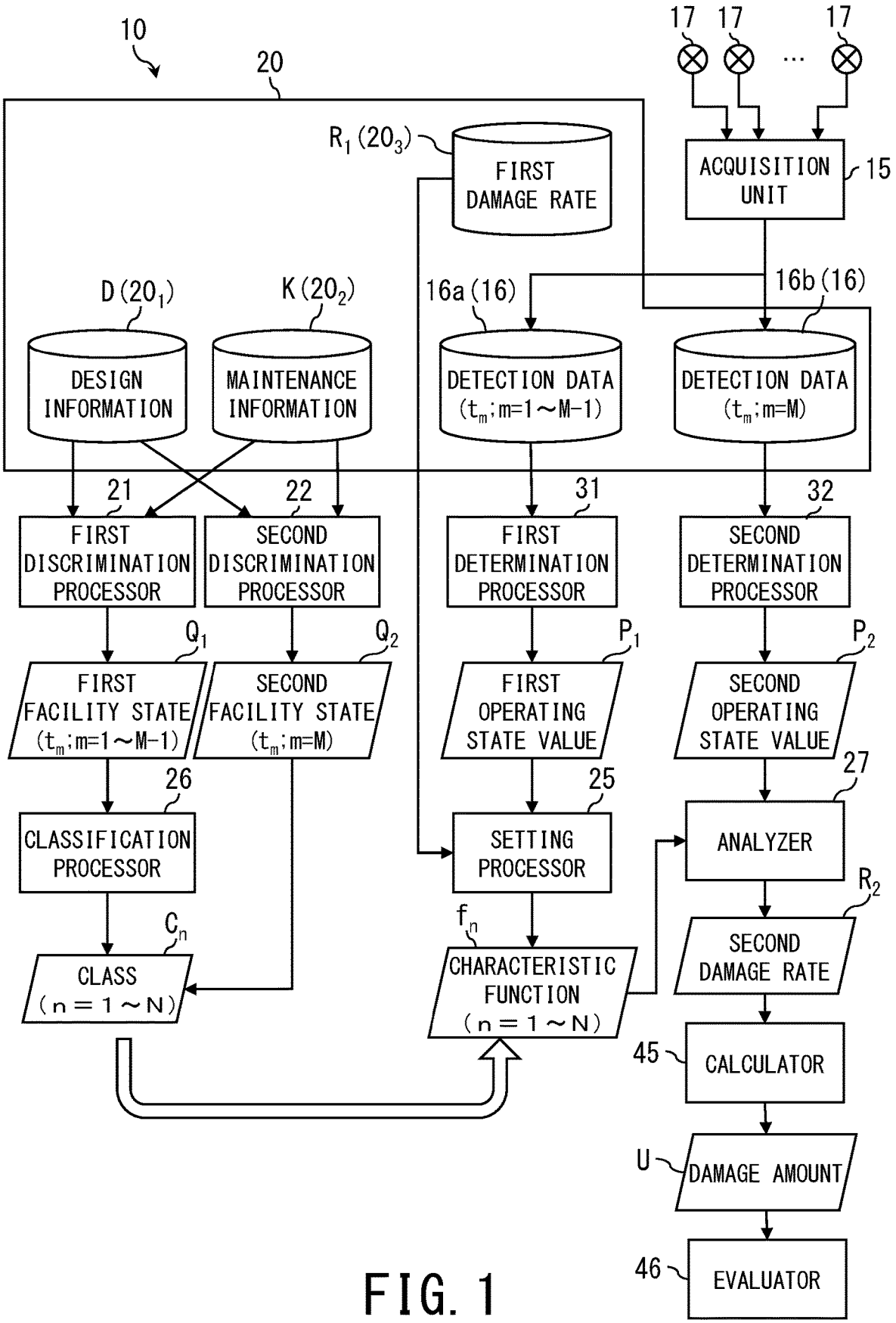
FIG. 1 is a block diagram illustrating a blade damage evaluation apparatus according to one embodiment of the present invention.
Figure 2:
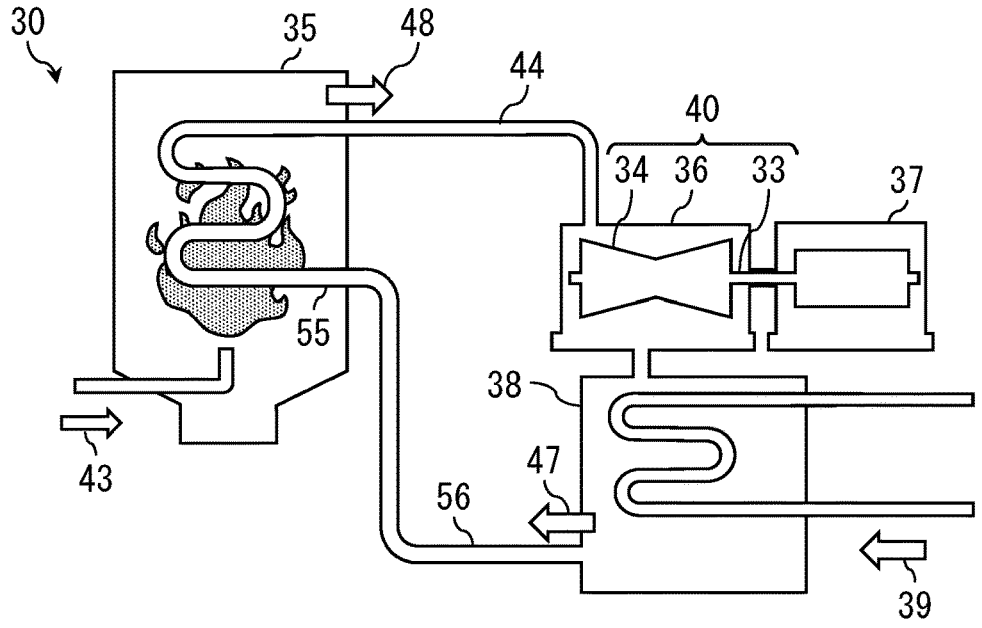
FIG. 2 is an overall diagram illustrating a thermal power plant to which the blade damage evaluation apparatus according to the present embodiment is applied.

Hereinafter, embodiments of the present invention will be described by referring to the accompanying drawings. FIG. 1 is a block diagram of a blade damage evaluation apparatus 10 according to one embodiment of the present invention. FIG. 2 is an overall diagram of a thermal power plant 30 to which the blade damage evaluation apparatus 10 (hereinafter, shortly referred to as the evaluation apparatus 10) according to the present embodiment is applied.

The evaluation apparatus 10 includes: a first registration unit 201 configured to register design information D on both of a steam turbine 40 having a plurality of blades 34, which rotate a rotor 33 around its axis by being subjected to a jet of steam 48 (FIG. 2), and peripheral devices of the steam turbine 40; a second registration unit $\mathbf{20}_2$ configured to register maintenance information K on work history that contributes to reduction of solid particles to be mixed into the steam 48; and an acquisition unit 15 configured to acquire and store detection data 16 from sensors 17 provided in the steam turbine 40 and its peripheral devices.

The evaluation apparatus 10 further includes: a first discrimination processor 21 that discriminates first facility states $Q_1$ of the steam turbine 40 at a plurality of past time points $t_m$ (m=1 to M−1) on the basis of the design information D and the maintenance information K; and a classification processor 26 that classifies each of the plurality of first facility states $Q_1$ into one of classes $C_n$ (n=1 to N).

The evaluation apparatus 10 further includes: a first determination processor 31 that determines first operating state values $P_1$ of the steam turbine 40 on the basis of the detection data 16*a* acquired at the past time points $t_m$ (m=1 to M−1); a third registration unit $\mathbf{20}_3$ that registers first damage rates $R_1$ of the blades 34 at the respective past time point $t_m$; and a setting processor 25 that sets a characteristic function $f_n$ (n=1 to N) indicative of the relationship between the first operating state values $P_1$ and the first damage rates $R_1$ for each of the plurality of classes $C_n$ (n=1 to N).

The evaluation apparatus 10 further includes: a second discrimination processor 22 that discriminates a second facility state $Q_2$ of the steam turbine 40 at the current time point $t_M$ on the basis of the design information D and the maintenance information K; a second determination processor 32 that determines a second operating state value $P_2$ of the steam turbine 40 on the basis of the detection data 16*b* acquired at the current time point $t_M$; and an analyzer 27 that analyzes a second damage rate $R_2$ at the current time point $t_M$ corresponding to the second operating state value $P_2$ on the basis of the characteristic function $f_n$ that has been set in the class $C_n$ corresponding to the second facility state $Q_2$.

As shown in FIG. 2, the thermal power plant 30 supplies fuel 43 to the inside of the boiler 35 to burn the fuel 43, and performs heat-exchange by using a heat exchanger 55 so as to gasify a liquid medium 47 into the steam 48. The steam 48 generated by the boiler 35 is led to a main steam pipe 44 and introduced into the steam turbine 40, and then is injected onto the blades 34 to rotate the rotor 33 supported by a casing 36. The rotor 33 rotationally drives a coaxially connected generator 37 so as to cause the generator 37 to convert rotational kinetic energy into electrical energy.

The steam discharged by working on the steam turbine 40 is cooled by a steam condenser 38 in which cooling water 39 circulates, and then is condensed to become the condensed water (i.e., liquid medium) 47. The condensed water 47 is resupplied to the heat exchanger 55 of the boiler 35 via a water supply pipe 56. In the present embodiment, the blades 34 include both of: rotor blades that are radially provided along the radial direction of the rotor 33 and rotate along with the rotor 33; and stator blades that are disposed in the gap of the arrangement of the rotor blades and fixed to the casing 36. Note that the term "peripheral device of the steam turbine 40" refers to an arbitrary device or component that is connected to the steam turbine 40 mechanically or via the steam 48.

The steam 48 sent from the boiler 35 to the steam turbine 40 is mixed with a large amount of liberated solid particles that are generated by being separated from the oxide film (scale) generated mainly on the interior surface of the heat exchanger 55. Such solid particles collide with the blades 34, and consequently, the blades 34 undergoes erosion called SPE (Solid Particle Erosion).

When the blades 34 are eroded (i.e., worn) and damaged by the collision with the solid particles contained in the steam 48, the injection conditions (such as the angle and speed) of the steam 48 to be injected from the stator blades to the rotor blades change and the internal efficiency (i.e., performance) of the steam turbine 40 is reduced. As the erosion (i.e., wear) progresses further, damage such as breakage and bent of the blades 34 develops. Further, it is conceivable that cracks develop and grow in a blade 34 and this blade 34 is blown away so as to collide with another normal blade 34 and damage it.

Thus, in the thermal power plant 30, consideration is given in design, maintenance, and operation to prevent the introduction of solid particles of scale from the boiler 35 in operation to the steam turbine 40. However, it is not possible to completely prevent such mixture of the solid particles into the steam 48. Thus, it is necessary to accurately monitor and predict the progress of the damage in the blades 34 due to SPE (Solid Particle Erosion).

Returning to FIG. 1, the first registration unit 201, the second registration unit $\mathbf{20}_2$, the third registration unit $\mathbf{20}_3$ and memories (i.e., storage units) for the detection data 16 (16*a*, 16*b*) may be configured as a common DB server 20 or as separate DB servers.

The design information D to be registered in the first registration unit 201 is mainly composed of one or a plurality of the following: design conditions of the power plant 30; design conditions of the boiler 35 (heat exchanger 55); design conditions of pipes such as the main steam pipe 44 and the water supply pipe 56; design conditions of steam valves (not shown); and design conditions of the turbine 40.

The design conditions of the power plant 30 include, for example, generation capacity and combined cycle/conventional cycle. The design conditions of the boiler 35 include, for example, rated operating conditions (such as temperature and pressure), fuel, a model name, capacity, and tube material. The design conditions of pipes such as the main steam pipe 44 and the water supply pipe 56 include, for example, material, length, exposure temperature, and presence/absence of a turbine bypass flow path. The design conditions of the steam valves include, for example, presence/absence of a fine mesh, and presence/absence of auxiliary valves. The design conditions of the turbine 40 include, for example, steam conditions (such as temperature, flow rate, and pressure), rotor blade structure (such as number of blades, PCD, blade length, blade-nozzle distance, rotational circumferential speed), stator blade structure (such as number of blades and an outflow angle), and blade strength characteristics.

The maintenance information K to be registered in the second registration unit $\mathbf{20}_2$ is mainly composed of one or a plurality of the following: maintenance data of the boiler 35 (heat exchanger 55); maintenance data of pipes such as the main steam pipe 44 and the water supply pipe 56; and maintenance data of the turbine 40.

The maintenance data of the boiler 35 include, for example, tube replacement, a descaling method, descaling frequency, descaling timing, and a flushing method. The maintenance data of pipes such as the main steam pipe 44 and the water supply pipe 56 include, for example, a descaling method, descaling frequency, descaling timing, and a flushing method. The maintenance data of the turbine 40 include, for example, replacement history or maintenance history of the first-stage rotor blades and first-stage stator blades. All of these data are registered in the second registration unit $\mathbf{20}_2$ as the maintenance information K on the work history that contributes to reduction of solid particles to be mixed into the steam 48.

The steam turbine 40 and its peripheral devices are provided with many sensors 17, and status monitoring of the power plant 30 is performed on the basis of the acquired detection data 16. The large amount of detection data 16 include data reflecting inflow conditions and/or collision conditions of solid particles, and are time-sequentially acquired by the acquisition unit 15 so as to be stored. Specifically, the detection data 16 from the steam turbine 40 include opening degree of the bypass valve, opening degree of the steam valve, and steam conditions around the first-stage rotor blades and first-stage stator blades. The detection data 16 from the peripheral device, which causes abnormality as a result of damage of to the blades 34 on the upstream side of the steam turbine 40, are also useful.

Both of the first discrimination processor 21 and the second discrimination processor 22 have a common function of discriminating the facility state $Q(Q_1, Q_2)$ of the steam turbine 40 on the basis of the design information D and the maintenance information K. The difference between both lies in that the first discrimination processor 21 discriminates the facility states of the steam turbine 40 (i.e., first facility states $Q_1$) at the respective past time points $t_m$ (m=1 to M−1) whereas the second discrimination processor 22 discriminates the facility state of the steam turbine 40 (i.e., second facility state $Q_2$) at the current time point $t_m$.

This means that the device conditions change with various improvements and/or introduction of maintenance during the operation cycle between periodic inspections even in the case of the same steam turbine 40. Even between different steam turbines 40, they can be discriminated with each other and be adopted as information on the first facility states $Q_1$.

The first damage rates $R_1$ of the blades 34 at the respective past time points $t_m$ (m=1 to M−1) are registered in the third registration unit $\mathbf{20}_3$. The first damage rates $R_1$ are obtained, for example, from the damage amount of the blades 34 actually measured in periodic major inspections for the steam turbine 40 or from simulation result combining various other information.

The first determination processor 31 determines each of the first operating state values $P_1$ of the steam turbine 40 on the basis of the detection data 16*a* acquired at the past time points $t_m$ (m=1 to M−1). As a result, the combination of the first facility state $Q_1$, the first operating state value $P_1$, and the first damage rate $R_1$ is established with the past time points $t_m$ (m=1 to M) included as the common term.

The classification processor 26 classifies each of the first facility states $Q_1$ at the respective past time points $t_m$ (m=1 to M−1) into one of the plurality of classes $C_n$ (n=1 to N) on the basis of commonality in damage characteristics of the blades 34. Thus, in the case of the first facility states $Q_1$ classified into the common class $C_n$, the blades 34 wear out at the same damage rate R with respect to the same operating state value P.

The setting processor 25 acquires the first damage rate $R_1$ related to the first operating state value $P_1$ from the third registration unit $\mathbf{20}_3$. The setting processor 25 sets the characteristic function $f_n$ indicting the relationship between combinations of the first operating state value $P_1$ and the first damage rate $R_1$ in the set of the first facility states $Q_1$ classified into the common class $C_n$. In this manner, the characteristic function $f_n$ (n=1 to N) is set for each of the plurality of classes $C_n$ (n=1 to N).

The damage rate R of the blades 34 is expressed by the general expression of the characteristic function $f_n$ in which the operating state value P and the class $C_n$ are used as independent variables, as Expression 1 below. Here, the facility state Q (Expression 3) is continuously expressed by the function g in which the design information D and the maintenance information K are used as independent variables, and the class $C_n$ (Expression 2) is expressed as transformation of the facility state Q by using a step function in which constants are stepwisely given for respective sections.

$$R=f_n(P,C_n) \quad \text{Expression 1}$$

$$C_n=[Q]_n \quad \text{Expression 2}$$

$$Q=g(D,K) \quad \text{Expression 3}$$

Figure 3:
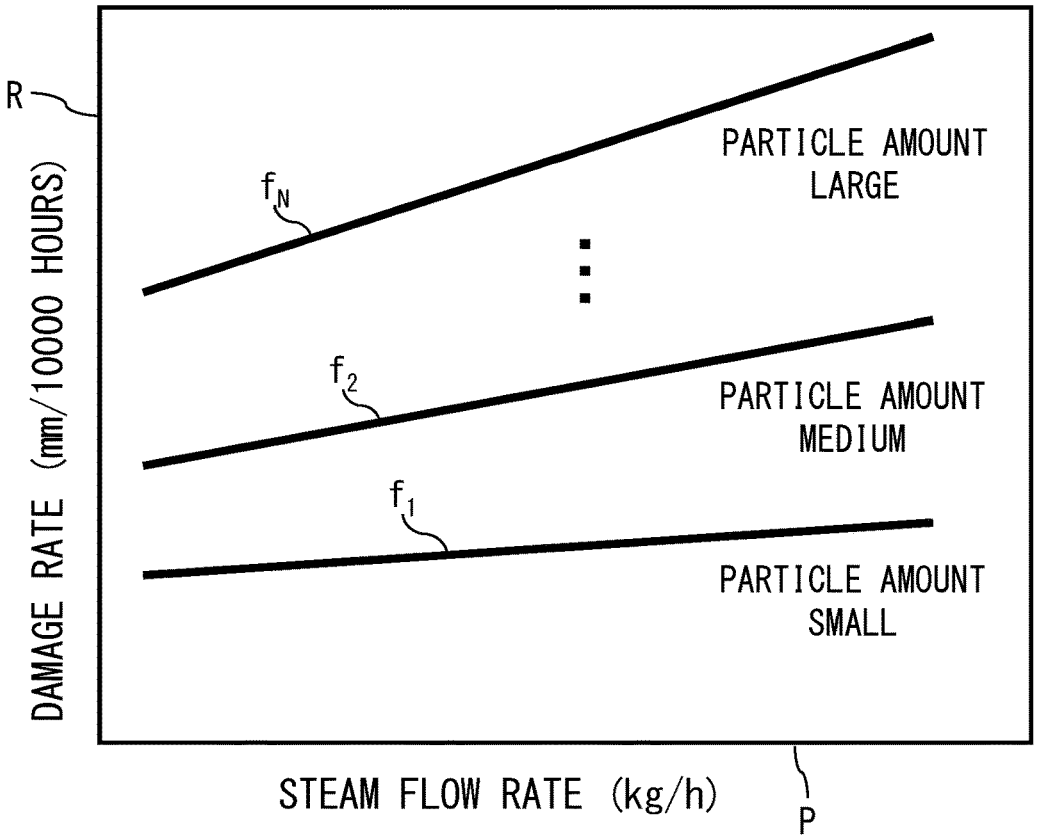
FIG. 3 is a graph of a characteristic function indicating the correspondence relationship between an operating state value of a steam turbine and a damage rate of blades.

FIG. 3 is a graph of the characteristic function $f_n$ indicating the correspondence relationship between the operating state value P of the steam turbine 40 and the damage rate R of the blades 34. For facilitating intuitive understanding, the operating state value P on the horizontal axis is expressed as the steam flow rate to be injected onto the blade 34, and each of the characteristic functions $f_n$ (n=1 to N) corresponds to each of the classes $C_n$ (n=1 to N) where solid particles are classified into large amount, medium amount, and small amount.

The second determination processor 32 determines the second operating state value $P_2$ of the steam turbine 40 on the basis of the detection data 16*b* obtained at the current time point $t_M$. In other words, the second determination processor 32 determines the second operating state value $P_2$ of the steam turbine 40 in operation on a real-time basis. Hence, the dynamically changing second operating state value $P_2$ can be traced accurately under adjustable thermal power conditioning which does not premise base load operation. Further, the characteristic function $f_n$ is prepared for each class $C_n$, and thus, the determined value of the second damage rate $R_2$ of the blades 34 accurately follows depending on the dynamically changing second operating state value $P_2$.

The analyzer 27 analyzes the second damage rate $R_2$ corresponding to the second operating state value $P_2$ on the basis of the characteristic function $f_n$ that is set for the class $C_n$ corresponding to the second facility state $Q_2$. In a continuous operation period of the thermal power plant 30, the class $C_n$ into which the second facility state $Q_2$ should be classified can be regarded as invariant or variable. The class $C_n$ (characteristic function $f_n$) into which the second facility state $Q_2$ should be classified can be maintained or changed depending on what is done (including what is not done) during the maintenance period between operation periods.

The calculator 45 calculates the damage amount U of the blade 34 on the basis of the second damage rate $R_2$. Specifically, the damage amount U is calculated by time-integrating the second damage rate $R_2$ obtained by the analyzer 27.

Figure 4:
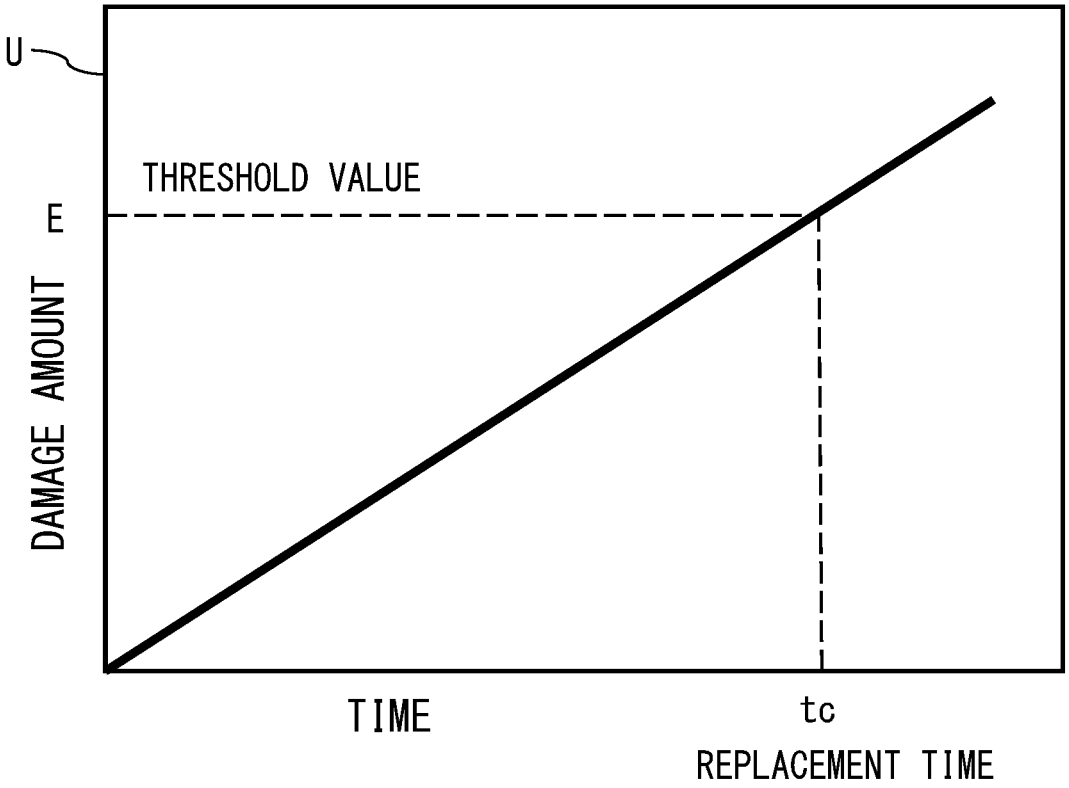
FIG. 4 is a graph illustrating temporal change in damage amount of the blades in associated with operation time.

FIG. 4 is a graph illustrating temporal change in the damage amount U of the blades 34 in associated with operation. The evaluator 46 evaluates the replacement time $t_c$ of the blades 34 on the basis of the damage amount U. Specifically, a threshold value E is defined as the limit value of the damage amount U at which safety of the blades 34 is ensured in terms of mechanical strength, and the time on the graph corresponding to this threshold value E is evaluated as the replacement time $t_c$ of the blades 34.

In addition, the evaluation apparatus 10 can simulate the second operating state value $P_2$ on the basis of future operating plans so as to analyze and predict the second damage rate $R_2$. On the basis of the predicted second damage rate $R_2$, the damage amount U and the replacement time $t_c$ can be further estimated.

The evaluation apparatus 10 includes an update processor (not shown) that updates the design information D and the maintenance information K each time a maintenance period between operation periods arrives. When the operation period ends and the next operation period arrives after the maintenance period, the detection data 16*b* at the time point $t_m$ can be specified by the first determination processor 31 as the detection data 16*a* at the past time point $t_m$ (m=1 to M). At this time, the second determination processor 32 determines the detection data 16*b* at the current time point $t_{M+1}$.

Figure 5:
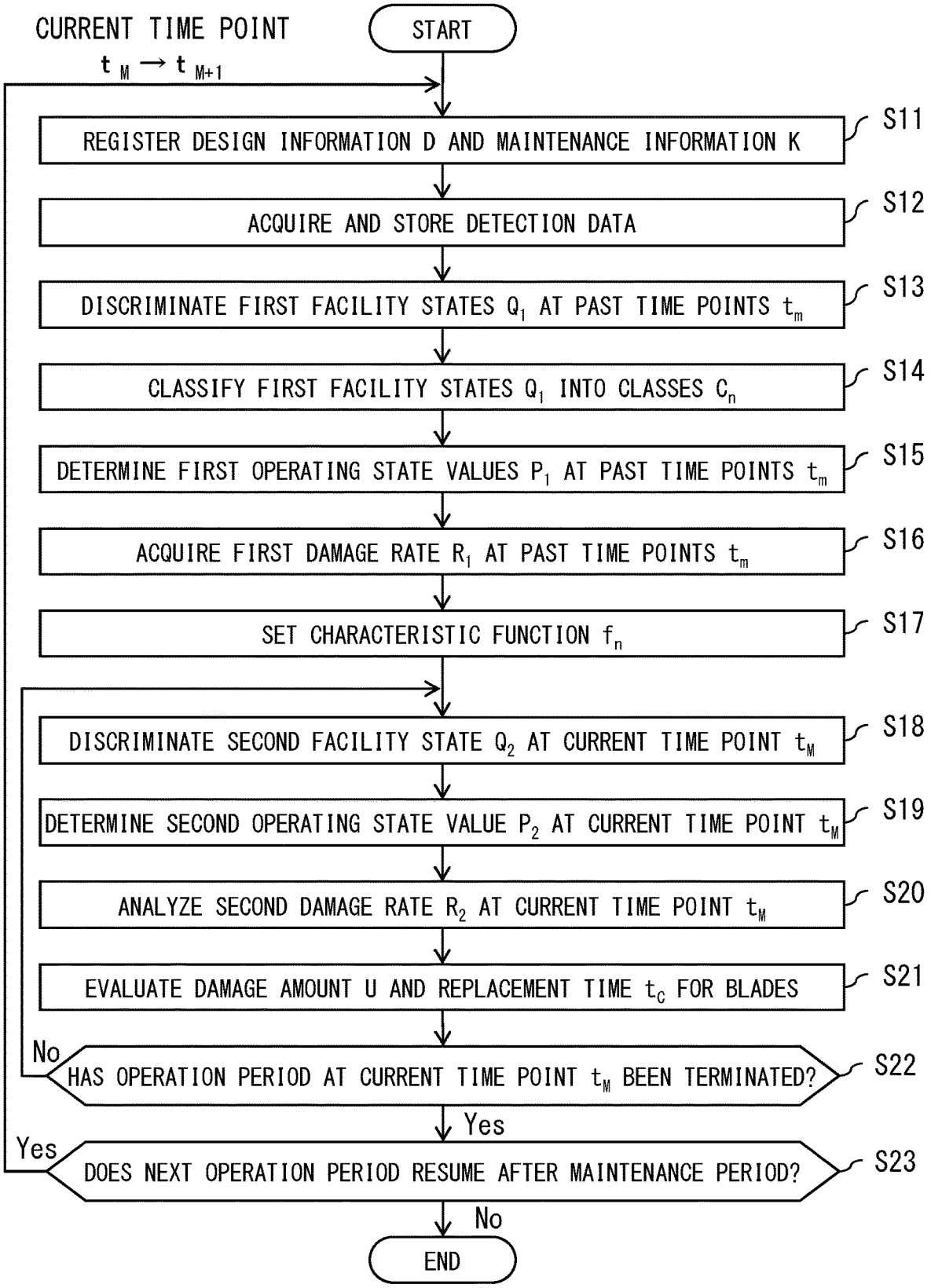
FIG. 5 is a flowchart illustrating steps of a blade damage evaluation method and algorithm of a blade damage evaluation program according to the present embodiment.

The processes of the blade damage evaluation method and the algorithm of the blade damage evaluation program are described on the basis of the flowchart of FIG. 5 by referring to FIG. 1 and FIG. 2 as required.

In the first step S11, the design information D on the steam turbine 40 and its peripheral devices is registered and the maintenance information K on the work history contributing to reduction of solid particles is registered.

In the next step S12, the detection data 16 of the sensors 17 are acquired and stored.

On the basis of the design information D and the maintenance information K, the first facility states $Q_1$ of the steam turbine 40 at the plurality of past time points $t_m$ (m=1 to M−1) are discriminated in the step S13, and each first facility state $Q_1$ is classified into one of the classes $C_n$ (n=1 to N) in the step S14.

In the next step S15, on the basis of the detection data 16*a* acquired at the past time points $t_m$, the first operating state values $P_1$ of the steam turbine 40 are determined.

In the next step S16, the first damage rates $R_1$ of the blades 34 at the past time points $t_m$ are acquired.

In the next step S17, the characteristic function $f_n$ (n=1 to N) indicative of the relationship between the first operating state value $P_1$ and the first damage rate $R_1$ is set for each of the plurality of classes $C_n$.

In the next step S18, on the basis of the design information D and the maintenance information K, the second facility state $Q_2$ of the steam turbine 40 at the current time point $t_M$ is discriminated.

In the next step S19, on the basis of the detection data 16*b* acquired at the current time point $t_M$, the second operating state value $P_2$ of the steam turbine 40 is determined.

In the next step S20, on the basis of the characteristic function $f_n$ having been set for the class $C_n$ corresponding to the second facility state $Q_2$ (FIG. 3), the second damage rate $R_2$ at the current time point $t_M$ corresponding to the second operating state value $P_2$ is analyzed.

In the next step S21, on the basis of this second damage rate $R_2$, the damage amount U of the blades 34 at the current time point $t_M$ and the replacement time $t_c$ of the blades 34 are evaluated.

The processing flow from the steps S18 to S21 is repeated until the operation period of the current time point $t_m$ is completed (i.e., until the determination result of the step S22 becomes YES).

If the next operation period resumes at the current time point $t_M$ after the maintenance period (YES in the step S23), the processing flow from the steps S11 to S22 is repeated.

If the operation period is not resumed, the processing is terminated (NO in the step S23).

According to at least one embodiment of the blade damage evaluation apparatus described above, the interrelationship between the design information, the maintenance information, the damage rate, and the sensor detection data at the past time points is clarified, the damage rate of the blades is analyzed on the basis of the sensor detection data at the current time point, the design information, and the maintenance information, and thus, it can provide technique for accurately evaluating the blade damage in a turbine to be operated under dynamically changing operating conditions. Although a description is given for the case of the steam turbine in the above-described embodiments, the present invention can be applied to gas turbines and other types of turbines.

While certain embodiments have been described, these embodiments have been presented by way of example only, and are not intended to limit the scope of the inventions. Indeed, the novel methods and systems described herein may be embodied in a variety of other forms; furthermore, various omissions, substitutions and changes in the form of the methods and systems described herein may be made without departing from the spirit of the inventions. The accompanying claims and their equivalents are intended to cover such forms or modifications as would fall within the scope and spirit of the inventions.

The above-described blade damage evaluation apparatus includes: a controller in which one or more processors such as a dedicated chip, an FPGA (Field Programmable Gate Array), a GPU (Graphics Processing Unit), and a CPU (Central Processing Unit) are highly integrated; a memory such as a ROM (Read Only Memory) and a RAM (Random Access Memory); an external storage device such as a HDD (Hard Disk Drive) and an SSD (Solid State Drive); a display; an input device such as a mouse and a keyboard; and a communication interface. The blade damage evaluation apparatus can be realized by general computer-based hardware configuration. Thus, components of the blade damage evaluation apparatus can be achieved by processors of a computer and can be operated by a blade damage evaluation program.

The blade damage evaluation program may be provided in the form of being pre-embedded in a ROM or similar device. Additionally or alternatively, the blade damage evaluation program can be provided as an installable or executable file stored in a computer-readable storage medium such as a CD-ROM, a CD-R, a memory card, a DVD, and a flexible disk (FD).

Moreover, the blade damage evaluation program according to the present embodiment may be stored on a computer connected to a network such as the Internet so as to be provided by being downloaded via the network. Furthermore, the blade damage evaluation apparatus can also be configured by interconnecting separate modules, which independently achieve the respective functions of the components, via a network or dedicated lines and combining these modules (such that these modules work in combination).

Although the respective functions of the blade damage evaluation apparatus 10 are mainly achieved by the processors (21, 22, 25, 26, 31, 32) and similar components (27, 45, 46) in the above-described embodiments, these processors and similar components may be configured as one integrated processor or one integrated processing circuit.

What is claimed is:

1. A blade damage evaluation apparatus comprising:

a first registration unit configured to register design information on a turbine and a peripheral device of the turbine, the turbine having a plurality of blades configured to rotate a rotor by being subjected to a jet of steam or gas;

a second registration unit configured to register maintenance information on work history that contributes to reduction in solid particles to be mixed into the steam or gas;

an acquisition processor configured to acquire and store detection data from sensors provided in the turbine and the peripheral device;

a first discrimination processor configured to discriminate first facility states of the turbine at a plurality of past time points based on the design information and the maintenance information;

a classification processor configured to classify each of the first facility states into one of classes;

a first determination processor configured to determine first operating state values of the turbine based on the detection data acquired at past time points;

a third registration unit configured to register first damage rates of the blades at the past time points;

a setting processor configured to set a characteristic function indicating relationship between a first operating state value and a first damage rate for each of the classes;

a second discrimination processor configured to discriminate a second facility state of the turbine at a current time point based on the design information and the maintenance information;

a second determination processor configured to determine a second operating state value of the turbine based on the detection data acquired at the current time point; and an analyzer configured to analyze a second damage rate at the current time point corresponding to the second operating state value based on the characteristic function that is set to a class corresponding to the second facility state.

2. The blade damage evaluation apparatus according to claim 1, further comprising a calculator configured to calculate damage amount of the blades based on the second damage rate.

3. The blade damage evaluation apparatus according to claim 2, further comprising an evaluator configured to evaluate replacement time of the blades based on the damage amount.

4. The blade damage evaluation apparatus according to claim 1, wherein the blade damage evaluation apparatus is configured to analyze and predict the second damage rate based on a future operation plan and the second operating state value obtained by simulation.

5. A blade damage evaluation method comprising steps of:

registering design information on a turbine and a peripheral device of the turbine, the turbine having a plurality of blades configured to rotate a rotor by being subjected to a jet of steam or gas;

registering maintenance information on work history that contributes to reduction in solid particles to be mixed into the steam or gas;

acquiring and storing detection data from sensors provided in the turbine and the peripheral device;

discriminating first facility states of the turbine at a plurality of past time points based on the design information and the maintenance information;

classifying each of the first facility states into one of classes;

determining first operating state values of the turbine based on the detection data acquired at past time points;

acquiring first damage rates of the blades at the past time points;

setting a characteristic function indicating relationship between a first operating state value and a first damage rate for each of the classes;

discriminating a second facility state of the turbine at a current time point based on the design information and the maintenance information;

determining a second operating state value of the turbine based on the detection data acquired at the current time point; and analyzing a second damage rate at the current time point corresponding to the second operating state value based on the characteristic function that is set to a class corresponding to the second facility state.

6. A computer-readable blade damage evaluation program that allows a computer to perform:

a registration process of registering design information on a turbine and a peripheral device of the turbine, the turbine having a plurality of blades configured to rotate a rotor by being subjected to a jet of steam or gas;

a registration process of registering maintenance information on work history that contributes to reduction in solid particles to be mixed into the steam or gas;

an acquisition process of acquiring and storing detection data from sensors provided in the turbine and the peripheral device;

a discrimination process of discriminating first facility states of the turbine at a plurality of past time points based on the design information and the maintenance information;

a classification process of classifying each of the first facility states into one of classes;

a determination process of determining first operating state values of the turbine based on the detection data acquired at past time points;

an acquisition process of acquiring first damage rates of the blades at the past time points;

a setting process of setting a characteristic function indicating relationship between a first operating state value and a first damage rate for each of the classes;

a discrimination process of discriminating a second facility state of the turbine at a current time point based on the design information and the maintenance information;

a determination process of determining a second operating state value of the turbine based on the detection data acquired at the current time point; and an analysis process of analyzing a second damage rate at the current time point corresponding to the second operating state value based on the characteristic function that is set to a class corresponding to the second facility state.

* * * * *